United States Patent [19]

Jan Van Tilburg

[11] 4,273,141

[45] Jun. 16, 1981

[54] SMOKE FILTERS

[76] Inventor: Jan Van Tilburg, 74 Lyceum Straat, Alkmaar, Netherlands

[21] Appl. No.: 886,399

[22] Filed: Mar. 14, 1978

[30] Foreign Application Priority Data

| | | | |
|---|---|---|---|
| Mar. 14, 1977 | [GB] | United Kingdom | 10607/77 |
| May 28, 1977 | [GB] | United Kingdom | 22634/77 |
| May 31, 1977 | [GB] | United Kingdom | 23042/77 |
| Jun. 21, 1977 | [GB] | United Kingdom | 25954/77 |
| Nov. 8, 1977 | [GB] | United Kingdom | 46317/77 |
| Nov. 15, 1977 | [GB] | United Kingdom | 47417/77 |
| Jan. 23, 1978 | [GB] | United Kingdom | 2576/78 |

[51] Int. Cl.[3] ..... A24D 3/04

[52] U.S. Cl. ..... 131/336; 131/338; 131/339; 131/340; 131/344

[58] Field of Search ..... 131/10.3, 10.5, 10.7, 131/10.4, 198 R, 198 A, 261 B, 261 A

[56] References Cited

U.S. PATENT DOCUMENTS

| | | | |
|---|---|---|---|
| 2,819,720 | 1/1958 | Burbig | 131/198 R |
| 3,756,250 | 9/1973 | Morgenstern | 131/10.3 |
| 3,811,451 | 5/1974 | Berger | 131/10 R |
| 3,910,288 | 10/1975 | Hammersmith et al. | 131/10.3 |
| 4,135,523 | 1/1979 | Luke et al. | 131/10.5 |

*Primary Examiner*—V. Millin

*Attorney, Agent, or Firm*—Emory L. Groff, Jr.

[57] ABSTRACT

A tobacco smoke filter having at least one directly ventilated cavity which provides for the formation, over a region of the filter extending inwardly of its peripheral region, of a mixture of at least the major proportion of the smoke and at least a major proportion of the ventilating air entering the said cavity or cavities. The extensive and uniform mixing of smoke and ventilation air gives a satisfying smoke with a low tar count and high nicotine/tar ratio, and can be obtained with the invention due to appropriate shaping of the cavity, or asymmetric positioning of the air ventilating vents, or by means of a flow-disturbing insert mounted in the filter, or a combination of two or more of these factors. Preferably a major part of the smoke is constrained to enter the cavity at an upstream peripheral extremity thereof and air vents are also concentrated at this extremity.

1 Claim, 15 Drawing Figures

SMOKE FILTERS

Figure 1:
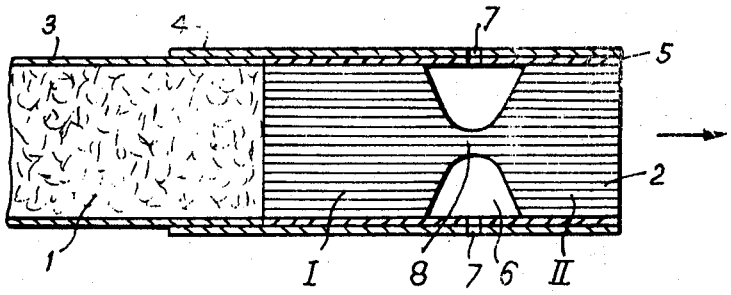

My invention concerns tobacco smoke filters, most importantly for cigarettes, and in particular ventilated tobacco smoke filters in which, during smoking, external air is drawn laterally through the peripheral wall of the filter to dilute smoke passing through the filter.

My invention resides, in one of its aspects, in a tobacco smoke filter having at least one directly ventilated cavity which provides for the formation, over a region of the filter extending inwardly of its peripheral region, of a mixture of at least the major proportion of the smoke and at least a major proportion of the ventilating air entering the said cavity or cavities.

I have found that in prior proposed ventilated tobacco smoke filters, including those which have been available commercially, the ventilating air after passing into the filter is substantially restricted, in its passage through the filter to the mouth end during smoking, to a narrow peripheral flow path through the filter; the ventilating air is thus used inefficiently, mixing substantially only with the smoke in the peripheral filter region, with the smoke passing centrally of the filter being substantially unaffected. The full benefits of air ventilation have thus not been realised. I believe it to be for this reason that in prior ventilated filters the degree of air dilution obtainable is severely limited if a smoke acceptable to the smoker is to be provided; thus prior ventilated filters are limited to a degree of air dilution on the order of about 20% or 30%; cigarettes with such filters having higher air dilution, e.g. 50% or 80%, are tasteless and unsmokeable, smoking like a "leaking" cigarette.

Use of filters of my invention permits maintenance of a smooth smoke of acceptable taste with air dilutions of up to 80% and greater, resulting in a filtered smoke of low tar content but low tar/nicotine ratio, this being of especial advantage and importance. Medical opinion indicates that it is the tar in tobacco smoke which is the health hazard, but that its content of nicotine, for which the tobacco is smoked, can with safety be quite high. My filters can also give high CO reduction and have been observed to give (compared to a cigarette of the same amount of tobacco with a conventional filter) up to 30% increase in smoking duration or conversely (compared to a conventional cigarette of the same smoking duration) up to 25% saving in tobacco.

Various embodiments of my filter are possible. In a first important type of embodiment the or each directly ventilated cavity is shaped to cause a variation, radially of the filter, of the speed of smoke flow into the cavity, thus engendering turbulence and hence extensive mixing of smoke and ventilation air in the cavity. Thus at least the upstream wall of the or each directly ventilated cavity may extend obliquely upstream or downstream from the filter periphery, the smoke at different radial positions then having different lengths of filter to traverse (and hence encountering different flow resistances) before reaching the cavity, resulting in a radial gradient of velocity of entry to the cavity. A similar but sometimes less pronounced turbulence effect can be obtained if the downstream face of the or each cavity extends up- or downstream from the filter wall, and of course both upstream and downstream faces may be so oriented. A plurality of such directly ventilated cavities may be provided, each extending only partially across the filter and spaced angularly and optionally longitudinally of one another.

In a second type of embodiment the ventilating air enters the filter non-uniformly around its periphery. Thus whereas in conventional ventilated filters perforations for admitting ventilating air are distributed uniformly in a ring around the wrapper(s) of the filter, in the instant invention the perforations (or air permeable region(s) of the wrapper(s)) for directly ventilating the cavity may be disposed non-uniformly circumferentially of the cavity. Thus in the case of a cavity which occupies the whole filter cross-section, direct ventilating air may enter at only one localised region around the circumference, or at two or more localised regions positioned asymmetrically around the cavity. Where a cavity extends only partially around the filter circumference, it can likewise be directly ventilated asymmetrically of the cavity circumference. The asymmetric direct ventilation also promotes turbulence and hence good mixing of the smoke and ventilation air internally of the filter periphery.

It can be advantageous to combine the features of the said first and second types of embodiment in the one filter.

In a third type of embodiment the required turbulence and extensive mixing of smoke and ventilation air is caused by the positioning of one or more flow-disturbing members in the filter; e.g. at or near the downstream end of the directly ventilated cavity an impermeable disc or the like may be mounted, the disc having one or more relatively restricted openings through which the smoke is constrained to pass. In another filter of this general type, at least one restricted channel may extend from the downstream face of the directly ventilated cavity through the material to open at the mouth end of the filter; the channel(s) may be disposed asymmetrically of the filter cross-section. Once again in this type of embodiment ventilation air is drawn inwardly of the filter periphery to give extensive mixing with the smoke.

In a fourth type of embodiment of my filter, a directly ventilated cavity therein is disposed and shaped, with an upstream wall extending obliquely downstream from the filter wall, to concentrate the flow of smoke into the cavity preferentially at the upstream peripheral region of the cavity, and the flow of ventilation air into the cavity is also concentrated at this region. Thus a major portion of the smoke passing through the filter is mixed, with all or a major part of the direct ventilation air, as soon as the smoke enters the cavity; a substantially uniform mixture of air and smoke can thus be formed in the filter and drawn into the mouth of the smoker. The cavity may for example have an upstream wall which tapers downstream from around the whole periphery of the filter, all or most of the direct ventilation air being constrained to enter the cavity around the upstream peripheral extremity of the cavity; or it might be an oblique gap across the filter, all or most of the direct ventilation air being constrained to enter the cavity at the most upstream region of its periphery.

The features of the third and fourth said types of embodiment may be combined with one another and/or with those of one or both of the said first and second types, in the one filter.

My filters can be made of the usual filtering materials, e.g. cellulose acetate filaments or fibres, usually along with a plasticiser, paper etc. Different filtering materials can be used for different parts (e.g. upstream and downstream of the cavity, radially inner and outer regions etc.) of the filter. When the paper is used as a filtering material, it can usefully comprise a percentage (up to 100%) of SWP (synthetic wood pulp); this will also facilitate the fixation of the cavity if it is formed by heat compressing (heat embossing or heat crimping).

The filters of my invention are effective in filtering smoke from all types of natural and synthetic tobacco and tobacco substitute (e.g. "Cytrel" and "NSM") and mixtures thereof.

At least where the inner surface of the wrapper immediately surrounding the filter is exposed to the cavity, this inner surface may carry a sticky or tacky material (e.g. non-drying or slowly-drying adhesive) to assist retention of tar and particulate matter from the smoke.

The or each directly ventilated cavity can contain a sorbent material, e.g. activated carbon, silica gel, etc., and/or a taste modifier such as menthol. Such additives could be present adhered to the said sticky or tacky material.

The or each cavity of my filters may be readily made or provided in many different ways e.g., starting from conventional rods, by cutting, or by compression of the rod at an elevated temperature at the localities where a cavity is to be formed, or by locally heating part of the rod, or by locally heating part of the rod followed by axial stretching (a neck is then formed), or in other suitable ways. A cavity can also be provided by juxtaposing, the required distance apart, two filter elements of appropriate opposing end configurations.

As indicated above my filters can markedly reduce the tar content of tobacco smoke whilst leaving it with a satisfactorily high nicotine/tar ratio. To enhance the latter ratio I can if desired incorporate additional nicotine, as such or in the form of a nicotine salt or other convenient derivative, in the tobacco to be smoked.

The direct ventilating air will usually enter into the directly ventilated cavity or cavities of my filters through perforations in the wrapper(s) surrounding the filter, but this is not essential and any such perforations may not be completely open. The wrapper(s) may instead have regions of inherently air permeable material separated by impermeable regions, and perforations may be covered by material (e.g. paper) of greater porosity than that of the material in which the perforations are formed.

Filters of my invention will normally have the directly ventilated cavity or cavities closed both upstream and downstream by filter material, but exceptions to this are possible, e.g. in the described case when the downstream portion of filter material has one or more restricted passages therethrough to promote turbulence within the cavity.

Figure 5:
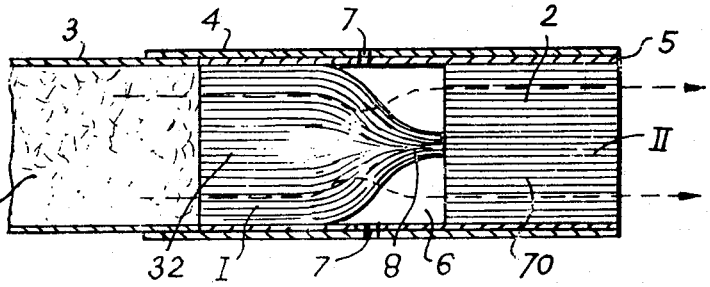
Figure 6:
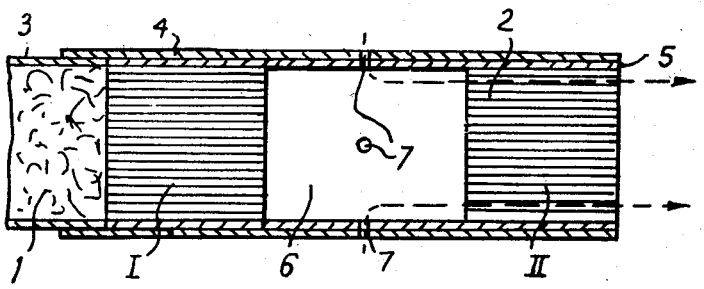

The invention, and various of its preferred features and advantages, are illustrated and explained in the following description to be read in conjunction with the accompanying drawings, in which:

FIGS. 1 to 5 and 7 to 15 are end (FIG. 10) or, side sectional views of filters according to the invention incorporated in a filtered cigarette; and FIG. 6 is a similar view of a ventilated filter not according to the invention.

In the drawings and following description, like reference numerals are employed to indicate like parts.

Thus in all of the figures there are shown a cigarette having a tobacco rod 1 wrapped in a paper wrapper 3 and connected to a filter 2 wrapped in a wrapper 5 by means of a tipping overwrap 4. Each filter has at least one cavity 6, which communicates with the external air by way of perforations 7 through the filter wrapper 5 and tipping overwrap 4. It will be appreciated that, whilst a tipping overwrap 4 is shown in all of the figures, other means, e.g. ring tipping, can be used to join rod 1 to filter 2. The filtering material of the filters shown in the drawings generally has an upstream portion I and downstream portion II.

Referring now to FIG. 1 of the accompanying drawings, the filter shown has a cavity 6 which is annular and has, through one or more small holes 7, direct access to the outside atmosphere. The effect of such a shaped cavity combined with direct air vents is advantageous; in experiments in which a cavity according to FIG. 1 was cut into a standard cellulose acetate filter element, about half-way along the length of the filter element, leaving a central portion 8 of about 2 mm., the result of smoking the filtered cigarette was that the first part of the filter (I) and the walls of the chamber 6 became heavily discoloured mainly with tar while the second part (II) became only faintly discoloured. The outside air, sucked into the chamber 6, seems to cause tar and particulate matter contained in the smoke to condense and deposit in the chamber 6, at least partly due to the turbulent flow created in the chamber because of the cavity shape. Between puffs, smoke is also able to escape through the air vents. The smoke inhaled has thus passed through very slightly polluted filtering material (II). A smoker cutting a conventional filter apart after having smoked a cigarette through it will be impressed by what such a filter has retained, but might also wonder what has not been retained and has gone through. Cutting apart a filter according to the invention, like that of FIG. 1, and seeing an almost clean part II, leaves no doubts about the filter's effectiveness.

Figure 2:
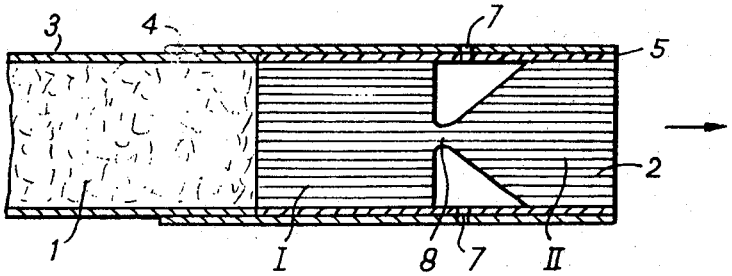

Variations in the configuration and nature of cavity 6 of FIG. 1 may be made, as shown for example in FIG. 2. Whilst FIG. 2 shows the upstream face of the cavity 6 as being perpendicular to the filter axis, the filter could be employed the other way round, with this perpendicular face constituting the downstream end of the cavity.

Furthermore, whilst the cavity 6 in FIGS. 1 and 2 is annular, it could in practice be replaced by one or more separate cavities spaced around the circumference of the filter with intervening walls of the material from which the filter is made. It is possible for the portion 8 shown in FIGS. 1 and 2 to be absent, the cavity 6 then extending fully across the cross-section of the filter, but this is not preferred.

Figure 3:
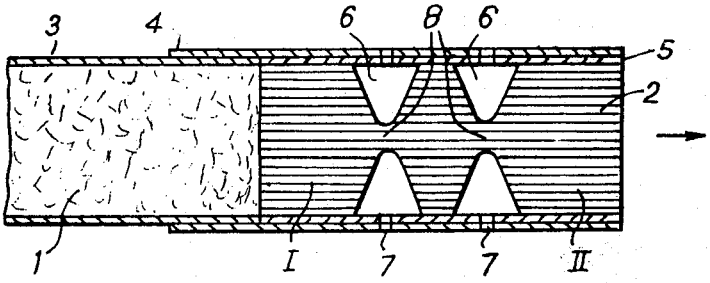

In another modification of the type of embodiment shown in FIGS. 1 and 2, a pair of longitudinally spaced annular cavities 6 are provided, each with their ventilation holes 7, as shown in FIG. 3; once again, each cavity 6 in this embodiment might be replaced by two or more separate cavities angularly spaced around the circumference of the filter.

In the latter type of embodiment, whether as shown in FIG. 1, 2 or 3, the cavity apices shown as being directly opposed could in practice be spaced from one another longitudinally of the filter, and the apex portion of the or each cavity might extend to over halfway across the filter.

Filters of the type shown in FIG. 1, 2 or 3 may be of cellulose acetate fibres or filaments; in conventional filters these would usually be more or less longitudinally aligned, but in my invention a twist in the fibre bundle, throughout the filter or for example in part I only, can be of advantage in increasing the turbulence in the cavity 6 and hence the filtering efficiency. The required turbulence may also be favoured if the portion 8 of the filters is disposed off-center.

The illustrated filters may of course be made of other materials, and different parts may be of different materials. For example a filter may have its upstream end of paper and its downstream end of cellulose acetate.

If desired, the portion 8 of the filter can be treated to render it less pervious or impervious, e.g. by heat pressing or by the application of an adhesive or of a solvent for the filter material in question, but this is not essential and a substantially impervious core portion 8 may in any case result naturally from the method of formation of the cavity or cavities.

The cavity or cavities in filters of the type illustrated in FIGS. 1 to 3 can be made readily by any of the methods previously mentioned, e.g. by cutting or deforming a conventional filter rod or by spacing end to end preformed rod portions of appropriate end configurations. Another way of forming a cavity is by means of a simple clamp or spring ring (e.g. of plastics or metal), which is fitted around a conventional filter rod to constrict it to a generally hour glass configuration, heat being applied where appropriate to assist in the constriction.

The core portion 8 in filters of the type illustrated in FIGS. 1, 2 and 3 need not be centrally positioned, and it need not have a simple, e.g. cylindrical configuration; its cross section may for example be square, triangular, S-shaped, Z-shaped, Y-shaped, or cruciform, etc. Its outside may touch the inside of the wrapper 5 in places, thereby sub-dividing the cavity 6 into two or more cavities in the manner described for example in U.S. Pat. No. 3,533,416 (American Filtrona Corporation) which I include herein by reference.

The core portion 8 of filters such as those of FIGS. 1 to 3 may be of different material than the filtering material(s) I and II; it may be a small rod of plastics material (polystyrene for example), or a small body of activated carbon, attached by adhesive to the remainder of the filter.

Figure 4:
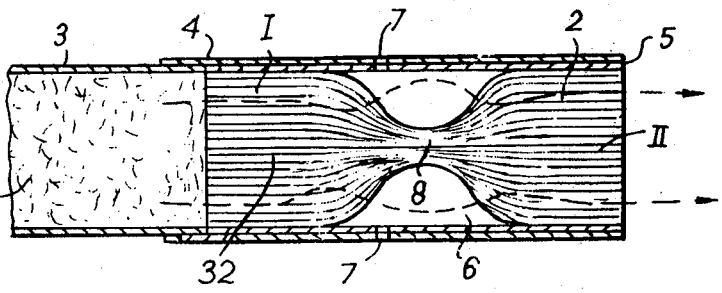

FIGS. 4 and 5 show further embodiments of my filter, of the same general type as those of FIGS. 1 to 3. In the FIG. 4 filter, the material 32 of portions I and II can be of creped paper, with the central core portion 8 being formed, for example, by squeezing this part of the filter together with the application of an adhesive. In this construction, the smoke is forced to go through the paper webs, rather than flowing only between them along their surfaces as in a conventional paper filter.

FIG. 5 shows another embodiment where the material 32 of portion I is likewise of creped paper, but in which the portion II is a separate element which may be of a different material 70, e.g. cellulose acetate fibre or filament.

It will be noted that in FIGS. 4 and 5 the vents 7 for directly ventilating the annular cavity 6 are disposed at the upstream end of the cavity in each case, this being especially beneficial in resulting in all of the direct ventilation air mixing with the majority of the smoke flow (which will be concentrated preferentially in the region of the upstream peripheral extremity of the cavity 6) as soon as the smoke enters the cavity. With the turbulence caused in cavity 6, assisted by its shape and by the disposition of the vents 7, uniform mixing of all of the direct ventilation air with substantially all of the smoke may thus be obtained to give satisfactory air dilution of the smoke issuing from the exit end of the filter over the whole of its cross section. The arrows in FIGS. 4 and 5 indicate generally a possible flow pattern for smoke through the filters.

FIG. 6 is a longitudinal sectional view through a cigarette provided with a filter which has a directly ventilated cavity but which is not according to the invention.

Figure 7:
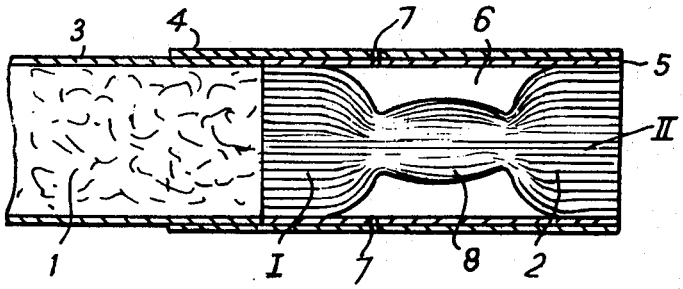

FIG. 7 is a similar view of a cigarette having a filter which is according to the invention and which has the same air dilution as the filter of FIG. 6. A variety of filters according to FIGS. 6 and 7 were made and attached to cigarettes, and the cigarettes were smoked for comparison. In each case, in comparison with the FIG. 7 embodiment, those according to FIG. 6 gave a much inferior taste and much lower tar removal, and the FIG. 6 filtered cigarettes were also very hard to draw. When cut open after smoking, the filters as shown in FIG. 7 were found to be markedly discoloured in the upstream section I and around the cavity 6, and to be slightly but uniformly discoloured across the downstream end of section II. Extensive and uniform air dilution had thus been obtained, the filters exhibiting excellent filtering efficiency whilst providing a smooth and tasteful smoke. The used filters according to FIG. 6 however were more discoloured over the length of the downstream section II, and this discolouration was not uniform, the outer peripheral portion of section II being much less discoloured than the remainder, indicating a restricted air flow path and hence limited extent of air dilution as indicated by the arrows in FIG. 6.

It will be noted that the vents 7 into the cavity 6 in FIG. 7 are disposed towards the upstream end of the cavity, this being beneficial as described above in connection with FIGS. 4 and 5.

Figure 8:
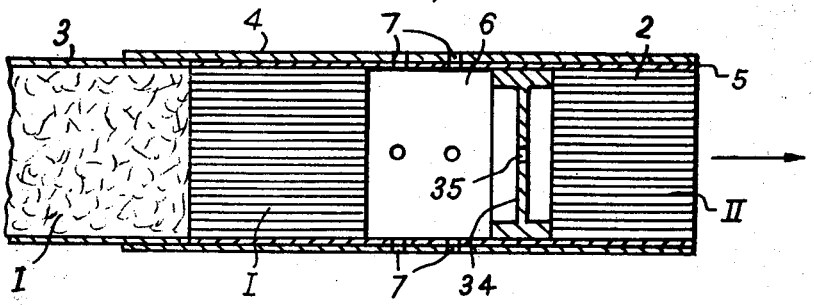
Figure 9:
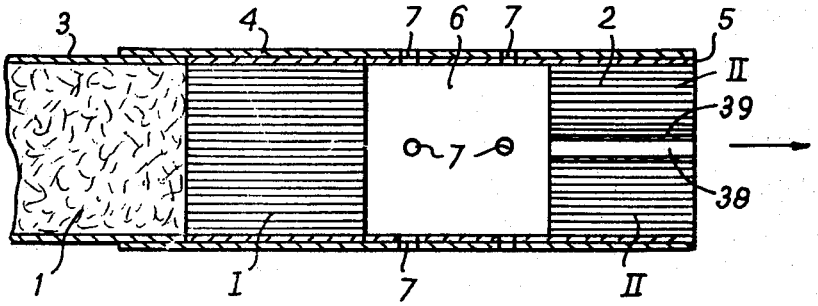
Figure 10:
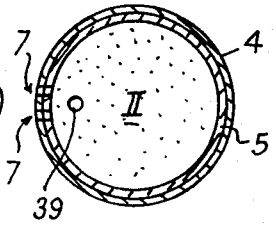

FIGS. 8 to 10 illustrate the use of filters having flow-disturbing inserts. Thus in FIG. 8, an insert or baffle 34 of impermeable material (e.g. plastics or metal), but having an opening for the escape of smoke from the cavity 6, is disposed at the downstream end of the cavity. The opening 35 through member 34 may be disposed off-center, and a plurality of such openings may be provided, preferably asymmetrically relative to the cross section of the filter. Since the air and smoke are constrained to divert their path for exit through the member 34, turbulence and hence extensive mixing of air and smoke can be achieved within the cavity 6. As shown in FIG. 8, it is preferred to leave a space between the opening(s) 35 of the member 34 and the downstream portion II of the filter. A member 34 with its opening(s) 35 could in addition or instead be disposed immediately downstream of section II of the filter, but this is not currently preferred.

FIG. 9 shows an embodiment of my filter in which, instead of a member such as 34 of FIG. 8, I create the required turbulence and mixing of smoke and direct ventilation air by providing a channel 38 through the downstream section II of the filter; the peripheral wall of the channel 38 may be defined by a tubular insert 39, e.g. of plastics material. In variations of the embodiment shown in FIG. 9, the channel 38 may be disposed off-center, and a plurality of such channels may be provided, preferably distributed asymmetrically over the cross section of the filter. Furthermore, the or each channel 38 may extend only partially from the downstream end of cavity 6 to the outlet end of section II of the filter.

FIG. 10, which is a cross sectional view taken across the cavity 6 of such a modified FIG. 9 embodiment, shows an example in which a single tubular insert 39 extending the length of filter section II is disposed off-center, and in which air vents 7 are provided only in the portion of the wall of cavity 6 which is adjacent to the upstream end of insert 39. Whilst FIG. 10 illustrates insert 39 as being disposed in the downstream filter section II, it could extend instead through the upstream section I of the filter.

Figure 11:
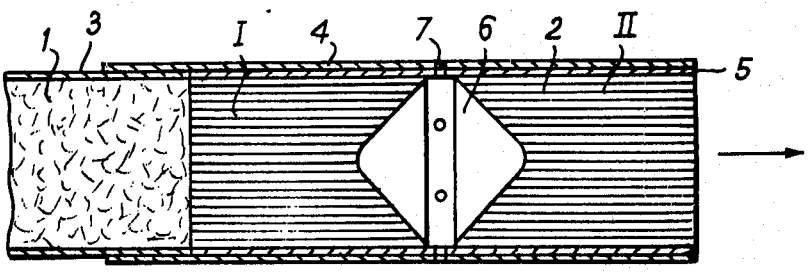

FIG. 11 of the accompanying drawings illustrates a filter according to the invention in which the upstream and downstream faces of the cavity 6 taper upstream and downstream respectively, the air vents 7 being disposed around a ring extending circumferentially of the filter and symmetrically of cavity 6. With this arrangement, the smoke entering cavity 6 centrally of the filter has a greater velocity than that entering the cavity 6 at the periphery of the filter, the radial velocity gradient due to this and to the corresponding shaping of the downstream face of cavity 6 engendering turbulence within the cavity to give the required extensive and uniform air dilution of the smoke passing through the filter.

Figure 12:
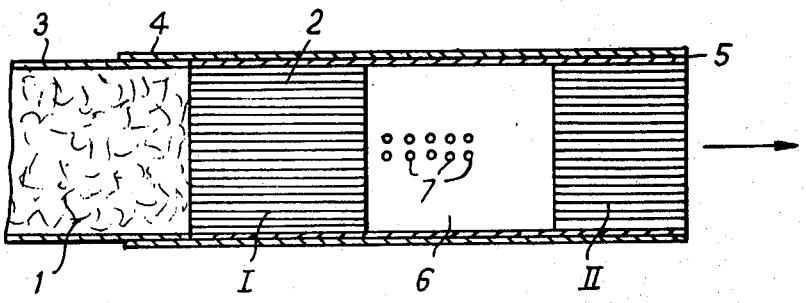

FIG. 12 of the accompanying drawings illustrates a different type of embodiment of my filter in which turbulence within the cavity 6 is brought about by the asymmetric distribution of the vents 7 around the periphery of the cavity 6. In conventional ventilated filters, the perforations or vents are distributed uniformly in a ring around the filter; by disposing the vents 7 instead over a single localised circumferential region of the filter, or over two or more such localised regions spaced irregularly around the filter wall, the required turbulence and extensive mixing of direct ventilation air and smoke can be obtained in the cavity 6 and the downstream section II of the filter.

Figure 13:
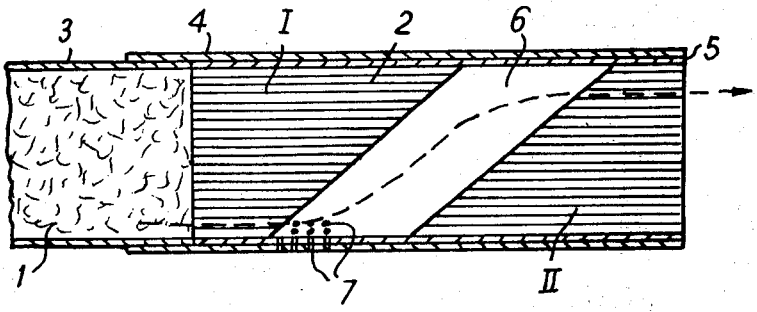
Figure 14:
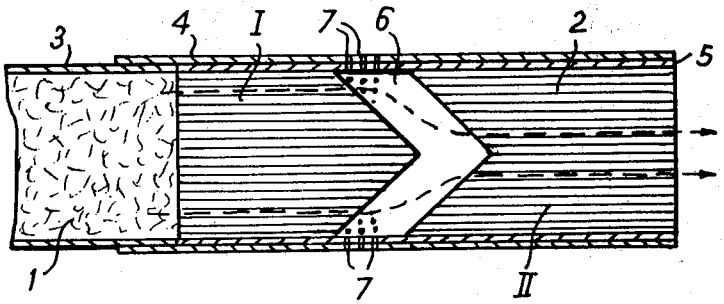
Figure 15:
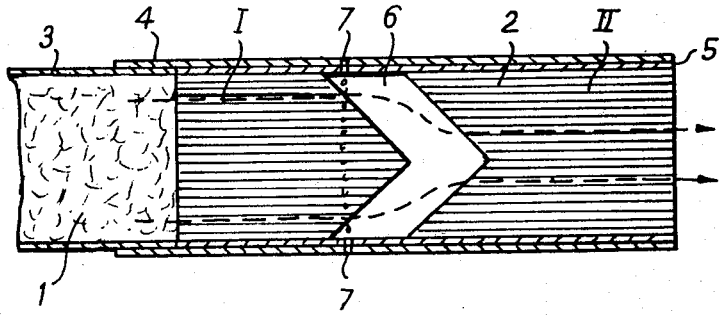

FIGS. 13 to 15 of the accompanying drawings illustrate a particularly effective type of embodiment of my inventive filter, in which a major portion of the tobacco smoke is constrained to flow into the cavity at a localised upstream peripheral extremity of the cavity, and in which all or most of the direct ventilating air is likewise constrained to enter the cavity at this extremity of the cavity due to disposition of all or most of the vents 7 or equivalent air-permeable regions of the filter wrapper(s) at this extremity. This ensures good mixing of a major proportion of the smoke with at least a major proportion of the direct ventilation air, hence allowing the full benefits of extensive and uniform air dilution to be achieved.

The filter shown in FIG. 13 has a cavity 6 constituted by a gap between upstream and downstream filter sections I and II extending obliquely across the filter; the upstream and downstream faces of cavity 6 are thus essentially elliptical, and the cavity has a localised upstream peripheral extremity and likewise a localised downstream peripheral extremity. According to my invention, I concentrate all or most of the air vents 7 at the said localised upstream peripheral extremity of cavity 6, which is where the flow of smoke into the cavity is also preferentially concentrated, so that I obtain immediate and extensive mixing of the smoke and the direct ventilation air. The arrows in FIG. 12 indicate a possible general flow pattern for smoke through the filter, and it will be appreciated that with the arrangement shown a substantially uniform air/smoke mixture will be obtained from the exit end of the filter.

FIG. 14 shows a similar embodiment, modified merely in that the cavity 6 of FIG. 13 is replaced by a cavity which is V-shaped in longitudinal section with two diametrically opposed substantially equivalent upstream peripheral extremities; in this case the air vents 7 are concentrated wholly or partly at these two extremities.

FIG. 15 shows another embodiment in which the cavity 6 is annular, the upstream and downstream faces of cavity 6 being conical; in this case, the upstream peripheral extremity of cavity 6 extends fully around the circumference of the filter, and the air vents 7 are disposed in a ring around the filter at this extremity.

The arrows in FIGS. 14 and 15 indicate possible flow paths of smoke through the filters concerned.

It will be appreciated that, in the accompanying drawings, the vents 7 are shown merely schematically. In particular, the size and number of vents 7 in each case will in practice be varied according to the degree of air dilution required, and is in no way restricted to that explicitly shown in the drawings.

The filter cigarettes according to the invention are ideally suited for marketing in e.g. four types under one brand name, each type having a different percentage of tar in the smoke (a small increase in the size and/or the number of the air vents reduces the tar in the smoke), so that the smoker, if he wants to, can, without changing his brand, gradually lower his tar intake, in the way the MD-4 cigarette holders are suggested to be used (U.S. Pat. No. 3,810,476).

Filters according to the invention are well suited to use in filter tubes for home-made cigarettes; such filtered tubes are provided in the form of an empty cylinder of cigarette paper closed at one end by a filter, the cigarette being made by the purchaser by filling the empty cylinder portion with tobacco.

Whilst my invention is essentially concerned with directly ventilated cavities, it is possible in some embodiments for there to be ventilation in addition into the body of the filter material (e.g. section I or II of FIG. 1 etc) through vents or permeable regions in the adjacent surrounding wrapper(s) of the filter.

In a development of the type of embodiment illustrated in FIGS. 8 to 10, the required turbulence can be created, instead of by the provision of restricted opening(s) 35 or channel(s) 38, by means of filter sections I or II which vary radially in flow resistance; for example a filter section I or II could have a core and surrounding portion of different materials and of different flow resistance.

In a quantitative test of a filter according to the invention, Rothmans and Embassy King Size filtered cigarettes as commercially available were modified by altering the filters into the form illustrated in FIG. 7; these modified cigarettes (obtained by removing the filters, separating the filter rod from each and heat-pressing its central portion to give a filter rod shaped as shown in FIG. 7, and recombining the modified filters with the original cigarettes as shown in FIG. 7), and the commercially available unmodified samples, were smoked and the results were compared. In the modified filter rods, the distance between the upstream and downstream extremities of the cavity 6 was 10 mm, and the wrappers 4 and 5 around the annular cavity 6 were perforated to give 80% air dilution. In most cases, these perforations or vents 7 were twenty in number, disposed uniformly around the circumference of the filter in two longitudinally spaced rings (10 vents in each) disposed symmetrically with respect to the cavity. On smoking, the unmodified commercially available cigarettes produced on average 20 mg of tar and 1.5 mg of nicotine, whereas the modified samples according to FIG. 7 produced on average 3.6 mg of tar and 0.53 mg of nicotine; the filters according to the invention thus markedly reduced the tar content of the filtered smoke, whilst increasing the nicotine/tar ratio from 0.07 to 0.15. This impressive improvement was obtained with full maintenance of taste and smoothness of the inhaled smoke, and of acceptable draw characteristics. The unmodified filters of the commercially available cigarettes were of cellulose acetate, about 20 mm. long and 8 mm in diameter.

It will be understood that the above description of the present invention is susceptible to various modification changes and adaptations.

What is claimed is:

1. A tobacco smoke filter comprising a body of tobacco smoke filtering material having a peripheral region, wrapping forming a tubular wall around said body, at least one cavity defined and substantially wholly enclosed by said body and wrapping and extending all to said tubular wall, each said cavity having a shape causing a variation, across the filter of the rate of smoke flow into the cavity, air-permeable means in said wrapping allowing direct passage of external ventilating air into said cavity or cavities through said wrapping, each said cavity having an upstream peripheral extremity, said air-permeable means being concentrated at said extremity, each said cavity further having an upstream wall extending obliquely downstream from said tubular wall, said filter body constraining the smoke flow in said cavity or cavities to concentrate at a peripheral region and said air-permeable means being disposed at said region of concentrated smoke flow whereby at least a major portion of tobacco smoke and said ventilation air entering said cavity or cavities form a mixture over a region of the filter extending inwardly of its peripheral region.

* * * * *